US008402601B2

(12) United States Patent
Fahlström

(10) Patent No.: US 8,402,601 B2
(45) Date of Patent: Mar. 26, 2013

(54) VACUUM CLEANER NOZZLE

(75) Inventor: Johan Fahlström, Sollentuna (SE)

(73) Assignee: AB Electronlux, Stockholm (SE)

( * ) Notice: Subject to any disclaimer, the term of this patent is extended or adjusted under 35 U.S.C. 154(b) by 582 days.

(21) Appl. No.: 12/524,323

(22) PCT Filed: Jan. 23, 2008

(86) PCT No.: PCT/SE2008/000056
§ 371 (c)(1),
(2), (4) Date: Apr. 14, 2010

(87) PCT Pub. No.: WO2008/091199
PCT Pub. Date: Jul. 31, 2008

(65) Prior Publication Data

US 2010/0218339 A1 Sep. 2, 2010

Related U.S. Application Data

(60) Provisional application No. 60/886,853, filed on Jan. 26, 2007.

(30) Foreign Application Priority Data

Jan. 23, 2007 (SE) ..... 0700159

(51) Int. Cl.
*A47L 5/10* (2006.01)
*A47L 5/26* (2006.01)

(52) U.S. Cl. ..... 15/389

(58) Field of Classification Search ..... 15/389, 15/391, 392, 363; *A47L 5/10, 5/26*
See application file for complete search history.

(56) References Cited

U.S. PATENT DOCUMENTS 2,226,581 A * 12/1940 Richardson ..... 15/41.1
2,707,792 A 5/1955 Waller
2,863,524 A 12/1958 Buda
(Continued)

FOREIGN PATENT DOCUMENTS

CA 2087056 7/1994
CN 1272873.X 1/2003
(Continued)

OTHER PUBLICATIONS

"The BOSS, Heavy Duty Rechargeable Vacuum, Model 98," Eureka brochure dated 1998, 2 pages.

(Continued)

*Primary Examiner* — Brian Glessner
*Assistant Examiner* — Brian D Mattei
(74) *Attorney, Agent, or Firm* — Hunton & Williams LLP

(57) ABSTRACT

The invention relates to a vacuum cleaner nozzle for cleaning of surfaces such as floors, comprising a rotatable, elongated brush (5), which is provided with brush means and located close to an air inlet opening to the vacuum cleaner. The brush is rotatably driven and adapted to rotate during cleaning to brush off debris and dust from the surface or to accomplish agitation of the surface. A first end of the brush is adapted to be mounted in the vacuum cleaner nozzle by moving the brush in an axial direction, while a second end of the brush is adapted to be mounted in the vacuum cleaner nozzle by moving the brush in a lateral direction, wherein the second end of the brush is maintained in a recess (13) by means of a releasable blocking element (7). The blocking element (7) is quick releasable without any need for a tool.

14 Claims, 5 Drawing Sheets

U.S. PATENT DOCUMENTS 3,199,138 A 8/1965 Nordeen
3,621,640 A 11/1971 Ohno et al.
3,653,189 A 4/1972 Miyake et al.
3,892,003 A * 7/1975 Peabody ..... 15/52.1
3,906,219 A 9/1975 Stauffer
4,213,224 A 7/1980 Miller
4,276,070 A 6/1981 Hug
4,376,322 A 3/1983 Lockhart et al.
4,421,964 A 12/1983 Buchtel
4,467,493 A 8/1984 Buchtel
4,541,142 A 9/1985 Pudwill
4,545,089 A 10/1985 Oxel
4,573,234 A 3/1986 Kochte et al.
4,573,237 A 3/1986 Kochte et al.
4,621,390 A 11/1986 Hampton et al.
4,635,315 A 1/1987 Kozak
4,665,582 A 5/1987 Richmond et al.
4,670,701 A 6/1987 Sako et al.
4,704,765 A 11/1987 Ataka
4,748,713 A 6/1988 Sepke et al.
4,766,638 A 8/1988 McDowell
4,787,923 A 11/1988 Fleigle et al.
4,804,481 A 2/1989 Lennartz
D300,214 S 3/1989 Adams
4,821,366 A 4/1989 Levine
4,831,685 A 5/1989 Bosyj et al.
4,841,594 A 6/1989 Elson et al.
D304,104 S 10/1989 Busalt et al.
4,876,763 A 10/1989 Cho et al.
4,894,882 A 1/1990 Toya
4,899,418 A 2/1990 Steiner et al.
D307,657 S 5/1990 Li
4,920,606 A 5/1990 Gerke, Jr. et al.
4,920,608 A 5/1990 Hult et al.
4,928,346 A 5/1990 Elson et al.
4,934,020 A 6/1990 Jackson
4,942,641 A 7/1990 Gerke, Jr. et al.
4,947,514 A 8/1990 Gerke, Jr. et al.
4,967,443 A 11/1990 Krasznai et al.
4,993,106 A 2/1991 Hult et al.
5,005,252 A 4/1991 Steiner et al.
5,020,187 A 6/1991 Kosten et al.
5,025,529 A 6/1991 Hult et al.
5,035,024 A 7/1991 Steiner et al.
5,065,473 A 11/1991 Krasznai et al.
5,107,567 A 4/1992 Ferrari et al.
5,309,600 A 5/1994 Weaver et al.
5,322,534 A 6/1994 Kaiser
5,342,433 A 8/1994 Avondoglio
D352,807 S 11/1994 Sanderud
D364,013 S 11/1995 Klingspor et al.
5,524,321 A 6/1996 Weaver et al.
5,561,885 A 10/1996 Zahuranec et al.
5,584,095 A 12/1996 Redding et al.
5,603,740 A 2/1997 Roy
5,661,885 A 9/1997 Donato
5,715,566 A 2/1998 Weaver et al.
5,733,351 A 3/1998 Hult et al.
5,819,364 A 10/1998 Sham
5,869,947 A 2/1999 Zahuranec et al.
5,966,774 A 10/1999 Bone et al.
6,029,313 A 2/2000 O'Dea et al.
6,094,775 A 8/2000 Behmer
6,108,864 A 8/2000 Thomas et al.
6,122,796 A 9/2000 Downham et al.
6,125,498 A 10/2000 Roberts et al.
6,131,239 A 10/2000 White
6,146,434 A 11/2000 Scalfani et al.
6,189,178 B1 2/2001 Roberts
6,226,832 B1 * 5/2001 McCormick ..... 15/391
6,311,366 B1 11/2001 Sepke et al.
6,324,714 B1 * 12/2001 Walz et al. ..... 15/52.1
6,428,589 B1 8/2002 Bair et al.
6,434,785 B1 8/2002 Vandenbelt et al.
6,546,592 B1 4/2003 Cockburn et al.
6,562,093 B2 5/2003 Oh
6,571,421 B1 6/2003 Sham et al.
6,625,845 B2 9/2003 Matsumoto et al.
6,647,587 B1 11/2003 Ohara et al.
6,658,693 B1 12/2003 Reed, Jr.
6,736,873 B2 5/2004 Conrad et al.
6,766,558 B1 7/2004 Matsumoto et al.
6,775,882 B2 8/2004 Murphy et al.
6,811,584 B2 11/2004 Oh
6,824,580 B2 11/2004 Oh
6,839,934 B2 1/2005 Houghton et al.
6,857,165 B2 2/2005 Oh
6,928,690 B2 8/2005 Ji
6,948,211 B2 9/2005 Stephens et al.
6,964,082 B2 11/2005 Hsu
6,968,596 B2 11/2005 Oh et al.
7,377,007 B2 5/2008 Best
7,383,609 B2 6/2008 Ji
7,386,916 B2 6/2008 Bone
7,404,838 B1 7/2008 Pathak
7,412,749 B2 8/2008 Thomas et al.
7,507,269 B2 3/2009 Murphy et al.
2002/0042969 A1 4/2002 Nagai et al.
2002/0073504 A1 6/2002 Hall et al.
2002/0088081 A1 * 7/2002 Vystrcil et al. ..... 15/389
2002/0189048 A1 12/2002 Maruyama et al.
2003/0019073 A1 1/2003 Oh
2003/0159235 A1 8/2003 Oh
2003/0163887 A1 9/2003 Inoue
2003/0208879 A1 11/2003 Oh et al.
2003/0213091 A1 11/2003 Oh et al.
2004/0040270 A1 3/2004 Inoue et al.
2004/0098957 A1 5/2004 Yoo et al.
2004/0103496 A1 6/2004 Worwag
2004/0134022 A1 7/2004 Murphy et al.
2004/0177471 A1 9/2004 Jung et al.
2004/0187253 A1 9/2004 Jin et al.
2004/0200029 A1 10/2004 Jin et al.
2004/0216263 A1 11/2004 Best
2004/0261212 A1 12/2004 Park et al.
2004/0261213 A1 12/2004 Park et al.
2005/0005390 A1 1/2005 Lee et al.
2005/0005391 A1 1/2005 Park
2005/0081321 A1 4/2005 Milligan et al.
2005/0125939 A1 6/2005 Hansen et al.
2005/0125940 A1 6/2005 McDowell
2005/0183406 A1 8/2005 Coburn
2006/0064828 A1 3/2006 Stein et al.
2006/0090290 A1 5/2006 Lau
2006/0156508 A1 7/2006 Khalil
2006/0179606 A1 * 8/2006 Worwag ..... 15/387
2007/0163075 A1 7/2007 Butler et al.
2007/0271724 A1 11/2007 Hakan et al.
2008/0178419 A1 * 7/2008 Courtney et al. ..... 15/363

FOREIGN PATENT DOCUMENTS

DE G 79 29 844.5 3/1981
DE 32 28 491 A1 2/1984
DE 33 09 162 A1 9/1984
DE 33 25 336 1/1985
DE 8623004 10/1986
DE 37 43 083 A1 6/1989
DE G 90 10 066.2 10/1991
DE G 91 14 371.3 4/1992
DE 4038262 6/1992
DE 19630286 1/1998
DE 10110581 11/2001
DE 10124216 1/2002
EP 0 170 720 2/1986
EP 0 215 619 A2 3/1987
EP 0 827 710 A2 3/1998
EP 0 853 917 7/1998
EP 0914795 A2 12/1999
EP 1 070 478 1/2001
EP 1 224 898 7/2002
EP 1 279 362 1/2003
FR 2603181 6/1987
GB 857580 12/1960
GB 990065 4/1965
GB 1201841 8/1970
GB 2035787 A 6/1980
GB 2137896 10/1984

| | | | |
|---|---|---|---|
| GB | 2155314 | | 9/1985 |
| GB | 2189382 | A | 10/1987 |
| GB | 2268875 | | 1/1994 |
| GB | 2291790 | | 7/1994 |
| GB | 2 349 105 | | 10/2000 |
| GB | 2 372 434 | | 8/2002 |
| GB | 2398486 | A | 8/2004 |
| GB | 2413942 | | 11/2005 |
| JP | 54-100149 | | 8/1979 |
| JP | 3-267032 | | 11/1991 |
| JP | 4364822 | | 12/1992 |
| JP | 52-73557 | | 10/1998 |
| JP | 2000-070198 | | 3/2000 |
| JP | 2001-095735 | | 4/2001 |
| JP | 2001353110 | | 12/2001 |
| JP | 2002 085297 | A | 3/2002 |
| JP | 2002 136456 | A | 5/2002 |
| JP | 2003 275154 | A | 9/2003 |
| SE | 514314 | C2 | 3/1998 |
| SE | 510283 | C2 | 10/1998 |
| WO | WO 97/20492 | | 6/1997 |
| WO | WO 03/009736 | | 2/2003 |
| WO | WO 2004/069021 | | 8/2004 |
| WO | WO 2005/111084 | | 11/2005 |

OTHER PUBLICATIONS

Black & white printouts of http://www.igia.com/prodetail.cfm?ID=AT7290 "IGIA Vac Blue" (3 pages).

Black & white printouts of http://www.igia.com/prodetail.cfm?ID=AT7691 "Wind Storm Wet/Dry Vacuum" (1 page).

Black & white printouts of http://www.igia.com/prodetail.cfm?ID=AT7739 "Wind Storm Vacuum" (3 pages).

Black & white printouts of http://www.sewserg.com/products/abp02698.html Miele S147 Little Giant Plus Vacuum Cleaner with Free 5 Yr Extended Warranty/Replacement (3 pages).

Black & white printouts of http://www.sewserg.com/products/abp09802-0775.html "Wind Storm AT7813 3in1 Upright, Stick & Hand Held Bagless Vacuum Cleaner Windstorm, 4 Attachments, Fold Down Handle for Storage, Weighs under 8 Pounds" (3 pages).

Black & white printouts of http://www.zweita.net/ "Product Info" (3 pages).

Fakir product pages catalogue, 2002 (5 pages).

* cited by examiner

VACUUM CLEANER NOZZLE

This application is a national stage application under 35 U.S.C. §371 of International Application No. PCT/SE2008/000056, filed Jan. 23, 2008, which claims the priority of Sweden Application No. 0700159-7, filed Jan. 23, 2007 and U.S. Provisional Patent Application No. 60/886,853, filed Jan. 6, 2007, the contents of both of which prior applications are incorporated herein by reference.

The invention relates to a vacuum cleaner nozzle for cleaning of surfaces such as floors, comprising a rotatable, elongated brush, which is provided with brush means and located close to an air inlet opening to the vacuum cleaner, wherein the brush is rotatably driven and adapted to rotate during cleaning to brush off debris and dust from the surface or to accomplish agitation of the surface, wherein a first end of the brush is adapted to be mounted in the vacuum cleaner nozzle by moving the brush in an axial direction, while a second end of the brush is adapted to be mounted in the vacuum cleaner nozzle by moving the brush in a lateral direction, wherein the second end of the brush is maintained in the recess by means of a releasable blocking element.

BACKGROUND OF THE INVENTION

It is previously known vacuum cleaner nozzles of different types having a rotating brush mounted in the vicinity of an air inlet opening to the vacuum cleaner. Such vacuum cleaner nozzles are sometimes used for regular vacuum cleaning, wherein the rotating motion of the brush is utilized to facilitate the vacuum cleaning by brushing debris and dust towards the air inlet opening, or to agitate the surface of a carpet to facilitate dust removal. Brushes are also used in carpet cleaning devices, wherein their rotating motion is utilized to accomplish agitation of the carpet surface, on the one hand for enabling working in of a cleaning agent between the carpet fibres, and on the other hand to facilitate releasing of the cleaning agent together with dirt from the carpet, after a desired time period after application of the cleaning agent, to permit withdrawal by the air flow through the air inlet opening.

However, one disadvantage associated with such rotating brushes is that debris and dust tend to adhere to them which can be difficult to remove. It is especially long and flexible items, such as hair and threads, that tend to get stuck. Once hair and threads have adhered also dust tend to accumulate on the brush. This is disadvantageous in that the brushing action will deteriorate and the accumulated debris will interfere with the air flow to the air inlet opening. To overcome this disadvantage it is known vacuum cleaner nozzles having a rotating brush, which has been made releasable from the vacuum cleaner nozzle in order to make it possible to release the brush from the nozzle and in this manner facilitate cleansing of the brush, after which the brush can be mounted in the vacuum cleaner nozzle again.

In these known vacuum cleaner nozzles, the brush is mounted in the vacuum cleaner nozzle in that a first end of the brush is connected to a driven wheel, wherein one of the driven wheel or the brush is provided with axially extending projections, while the other is provided with axially extending recesses, such that the end of the brush can be connected to the driven wheel by moving the brush in a substantial axial direction towards the driven wheel. A second, free rotating end of the brush is mounted in the vacuum cleaner nozzle by moving the end of the brush in a lateral direction into a recess in the vacuum cleaner nozzle. When the brush is in its intended position in the recess, the second end of the brush can be locked in the vacuum cleaner nozzle by means of a blocking element, which is placed over the recess and locked by means of a screw fastening.

However, one disadvantage with this vacuum cleaner nozzle having a releasable brush, is that some form of tool, such as a screw driver, is required to release the screw for dismounting the blocking element. This is a disadvantage for the user, which maybe do not have a tool ready to hand when needed. Thus the user either has to go and get a tool or to use a substitute for a tool, e.g. a knife, a coin or the like, to be able to unfasten and tighten the screw. It has also been found that the engagement formation, such as a screw driver slot, tend to wear out after some time of use, especially when using a tool which is not adapted for this purpose, such as a knife or the like. It is also common that users do not understand that the brush is releasable by loosing the screw, resulting in that the brush remains clogged by debris and dust.

SUMMARY OF THE INVENTION

It is an object of the invention to provide a vacuum cleaner nozzle having a rotating brush, which is easy releasable for cleansing. At least this object is achieved by a vacuum cleaner nozzle according to claim 1.

Accordingly, the basis for the invention is the insight that the above object may be achieved by arranging the rotating brush quick releasable from the vacuum cleaner nozzle by means of a releasable blocking element, in particular a quick releasable blocking element. In this way it is facilitated for the user to remove the brush from the vacuum cleaner nozzle without the need for any tool, to cleanse the brush from debris and dust and subsequently reassemble the brush on the vacuum cleaner nozzle.

Within this overall inventive idea, the invention can be implemented in many different ways. In a hereinafter described and in the drawings shown embodiment of the invention, one of the ends, the driven end of the rotating brush can go into engagement with a driven wheel in one of the ends of the nozzle by means of projections, which projects in the axial direction of the brush and goes into engagement with axially extending recesses in the driven wheel such that the wheel and the brush can be brought into engagement with each other by moving the brush in a substantially axial direction towards the driven wheel. However, it is evident that the projections also could be arranged on the driven wheel, whereas the recesses can be arranged on the brush. In the other end, the free rotating end, the brush is provided with an axle spindle, which is rotatable journalled on the brush. The axle spindle has a square outer cross sectional shape and can be laid into a rectangular recess in the nozzle, having two opposed plain walls being in parallel to the extension of the brush, by moving the brush laterally towards the nozzle. A releasable and lockable blocking element is positioned over the rectangular recess, such that the rotatable journalled axle spindle is prevented from being removed from the rectangular recess. In this way the first end of the brush, is driven by the driven wheel, by means of the projections and recesses being in engagement, while at the same time the brush is prevented from falling out from the driven wheel due to the axial extension of the projections and the recesses and that the brush is prevented from axial movement due to the rotatable journalled axle spindle abutting an end wall of the rectangular recess. In the second end of the brush, the rotatable journalled axle spindle is prevented from rotating in relation to the nozzle due to the engagement between the square shaped axle spindle and the rectangular recess, such that the brush is rotated in relation to the axle spindle having the effect that the brush will be rotary journalled in this end.

However, it is to be understood that also this second end could be formed in different ways. The positive locking between the axle spindle and the recess could for example be achieved with other shapes than the square cross section of the axle spindle and the recess, e.g. with a triangular cross section of the spindle, which goes into engagement with a V-shaped recess in the nozzle. Also in this way the rotatable journalled axle spindle would be prevented from rotating in relation to the nozzle. However it would also be conceivable to let the rotatable axle spindle be circular in cross section, which is seated in a semicircular recess in the nozzle, and allow some rotation between the rotatable axle spindle while the main rotation occurs between the rotatable axle spindle and the brush. It is also possible to dispense of the rotatable journalled axle spindle and to position an axle end of the brush in an axle bearing in the recess.

The blocking element is an element separate from the brush that is positioned over the recess in order to cover it and maintain the end of the brush in the recess. Also the blocking element can be formed in many different ways. In a hereinafter described and shown embodiment, the blocking element is locked and released by means of a separate actuator having a release button. In one end the blocking element has a projecting portion, which is inserted in a slot in the vacuum cleaner nozzle. The other end of the blocking element is formed with a hook element, which in a locked state is in engagement with a ratchet element in one end of the actuator, which is spring actuated towards the locking state. However, the blocking element and the actuator, as well as the engagement between them, could be formed in many other ways. For example it is not necessary that the actuator is spring forced towards the locking state. Instead the actuator could be formed as having two different positions, namely one locking position and one releasing position. It is also possible to form the blocking element and the actuator as one unitary element, i.e. in the locking position the combined blocking element and actuator blocks the recess for the second end of the brush, wherein in a releasing position it is displaced from the recess such that it is open. In the described and shown embodiment of the invention, the blocking element is substantially flat and thin, as a cover or the like. However, it is to be understood that the blocking element could be formed in many other different ways. The blocking element in the described and shown embodiment of the invention is also an element that can be removed from the nozzle. However, the blocking element could also be an element connected to the nozzle by a hinge connection or a pivoting connection or the like, which connection would allow the blocking element to be moved from a position covering the recess to a position not covering the recess, but where the element is still attached to the nozzle.

As mentioned before, the vacuum cleaner nozzle can be of different types. As for example nozzles adapted for vacuum cleaning alone, or nozzles adapted for carpet cleaning and hence agitating of the surface for working in of a cleaning agent into the carpet and subsequent brushing up of the cleaning agent from the carpet.

The word brush shall in this application not encompass only what is traditionally meant by the word brush, such as devices having projecting bristles arranged in different ways, such as helically or spread out, over its surface, but also devices having flexible lamellas or blades, such as rubber lamellas or blades, or devices having a felt like material, or devices having a soft or flexible material, such as foam, arranged in different ways, such as helically or spread out, over its surface, or any other device displacing debris and dust towards the air inlet opening, or agitating the surface to be cleaned in order to either facilitate dust removal from a carpet or the like or to enable working in of a cleaning agent in a carpet in the case of a carpet cleaning device.

The driving of the brush can be accomplished in different ways, i.e. by means of a separate electrical motor or a turbine wheel, which is rotated by the air flow through the air inlet opening and which in its turn drives the driven wheel by means of a suitable mechanism, e.g. a shaft and a driving belt.

BRIEF DESCRIPTION OF THE DRAWINGS

An embodiment of the invention will be described hereinafter, by way of example, by reference to the accompanying drawings, in which.

DETAILED DESCRIPTION OF ONE EMBODIMENT OF THE INVENTION

Figure 1:
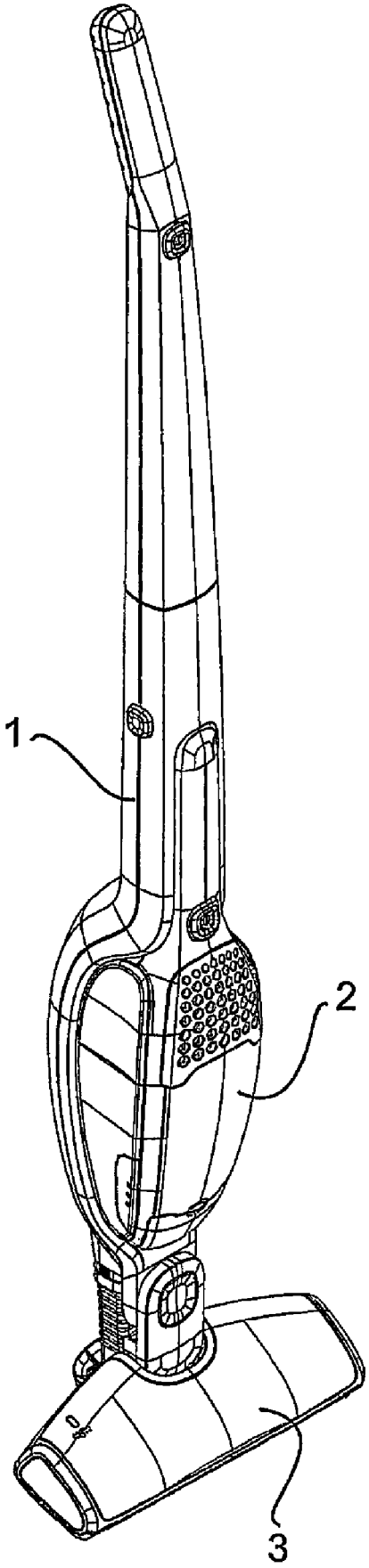
FIG. 1 is a perspective view of a vacuum cleaner according to one embodiment.

In FIG. 1 is shown an example of a vacuum cleaner in which the present invention may be implemented. This vacuum cleaner is of a so called 2-in-1 type having an elongated, stick formed support body 1 in which a hand held unit 2 can be mounted, to perform vacuum cleaning by means of a vacuum cleaner nozzle 3 attached to a lower end of the support body. The hand held unit 2 can also be released from the support body to perform vacuum cleaning with the hand held unit separately.

Figure 2:
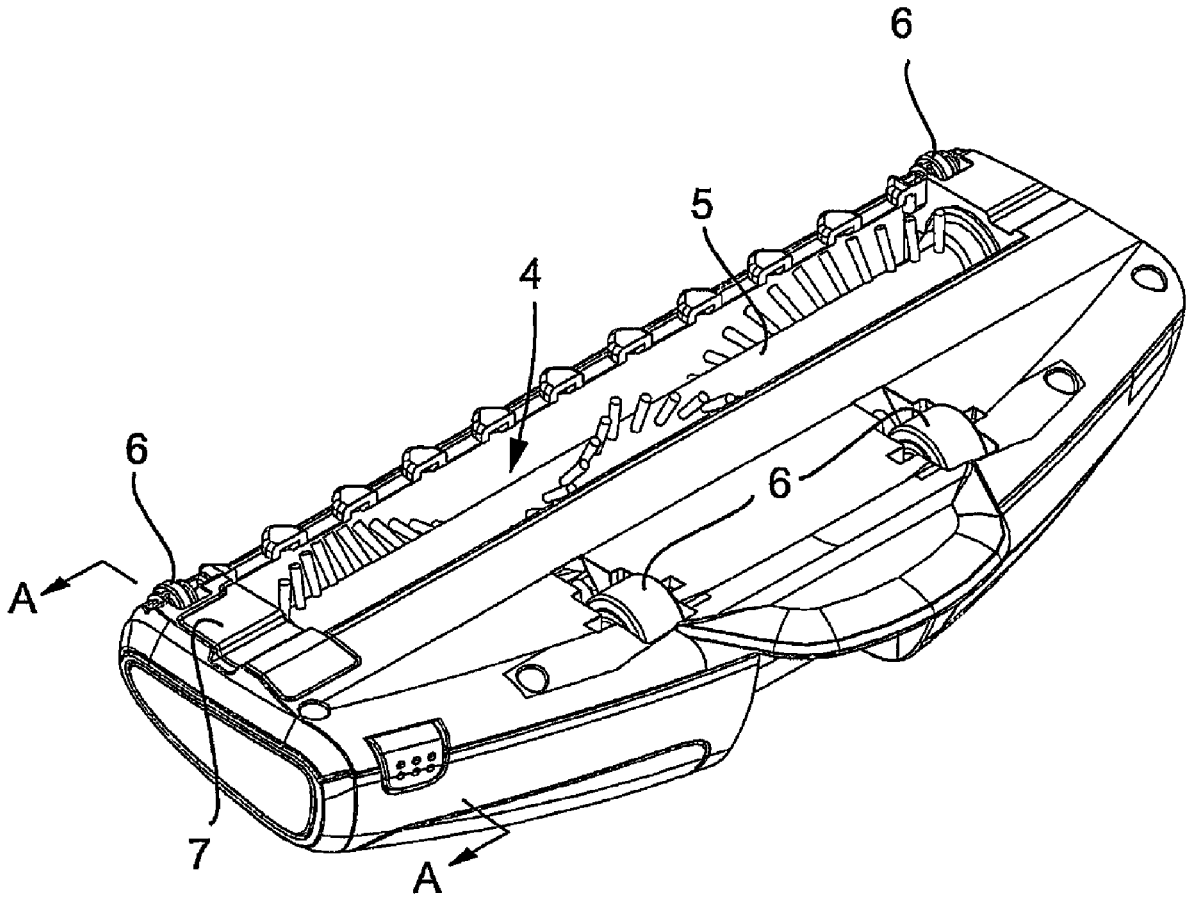
FIG. 2 is a perspective view of the bottom side of the vacuum cleaner nozzle according to FIG. 1.

In FIG. 2 is shown the bottom side of the vacuum cleaner nozzle 3. As is evident from the drawing, the vacuum cleaner nozzle is formed with an elongated slot 4, from which a not shown air inlet opening extends and in which also a rotatable, elongated brush 5 is positioned. To facilitate moving of the vacuum cleaner nozzle over a floor, it is provided with four wheels 6.

Figure 3:
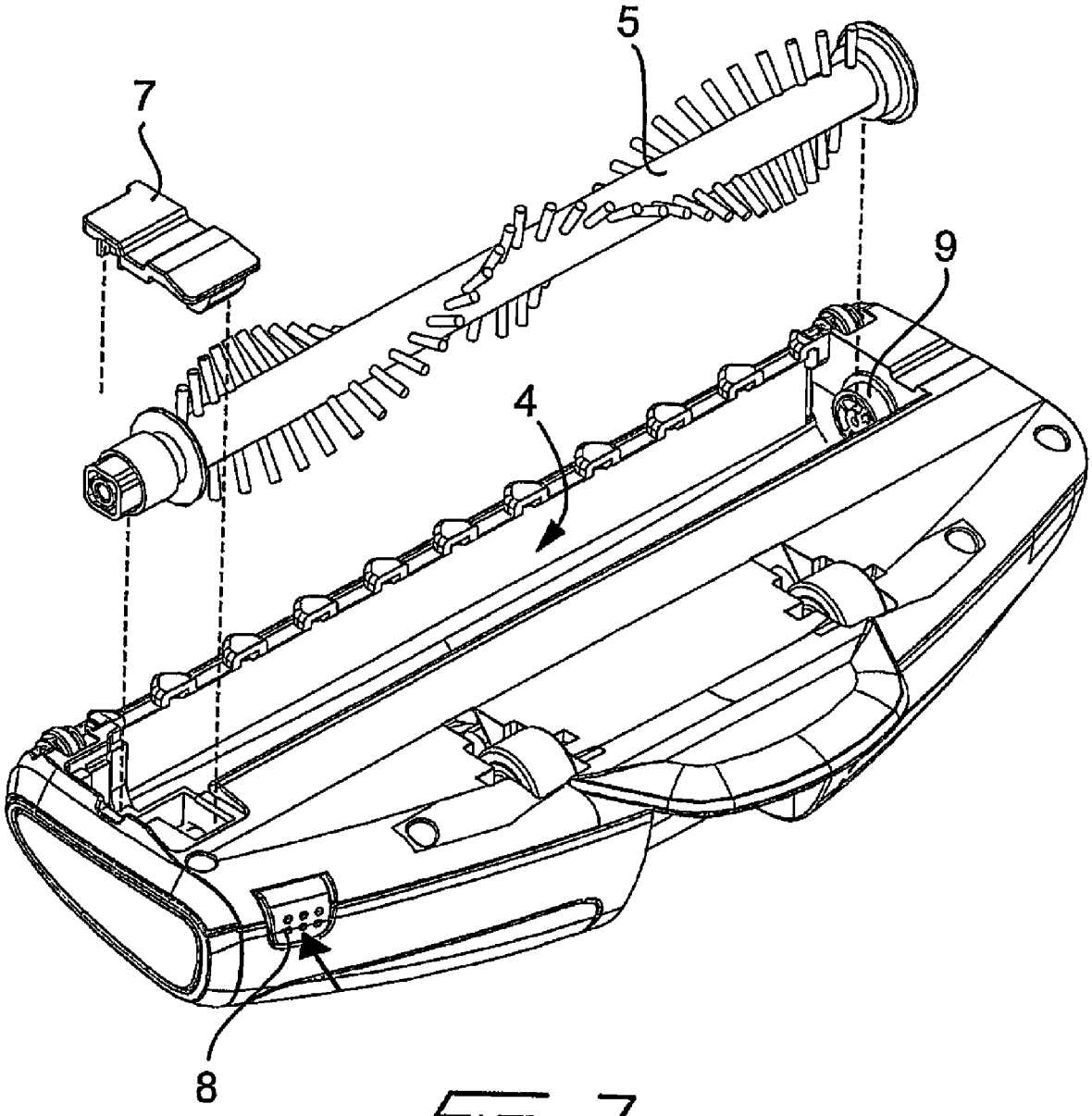
FIG. 3 is a perspective view according to FIG. 2 with the rotating brush removed from the vacuum cleaner nozzle.

In FIG. 3 the vacuum cleaner nozzle is illustrated with the brush 5 removed from the slot 4. This can be accomplish by removing a blocking element 7 by pushing a release button 8.

Figure 4:
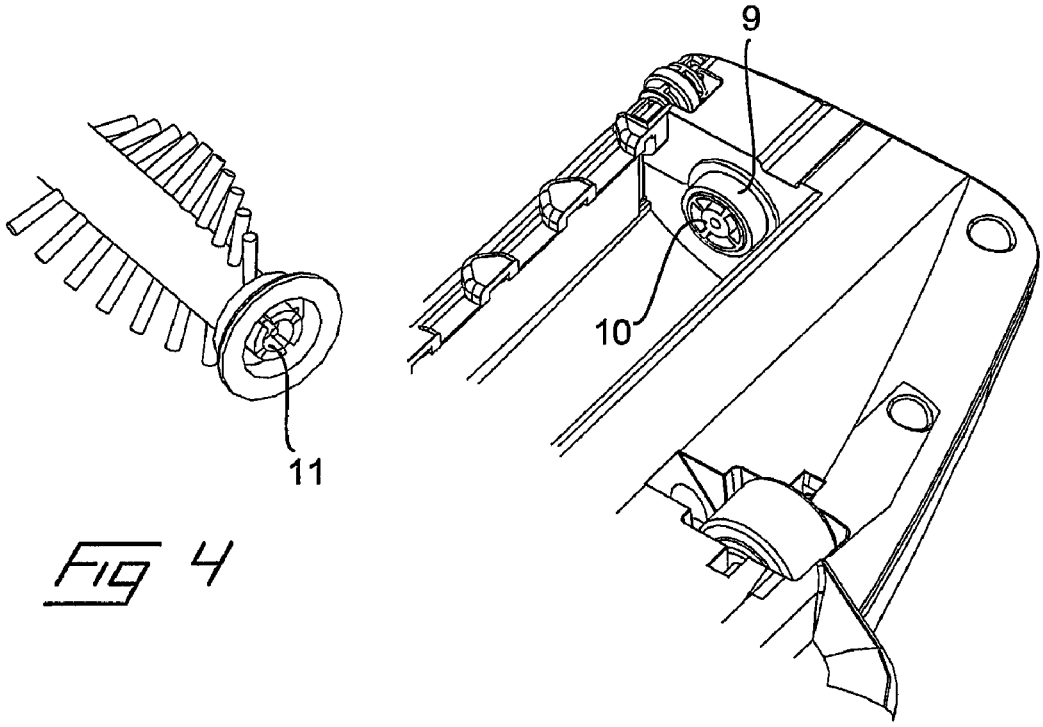
FIG. 4 is a perspective view illustrating the driven end of the vacuum cleaner nozzle and the brush.
Figure 5:
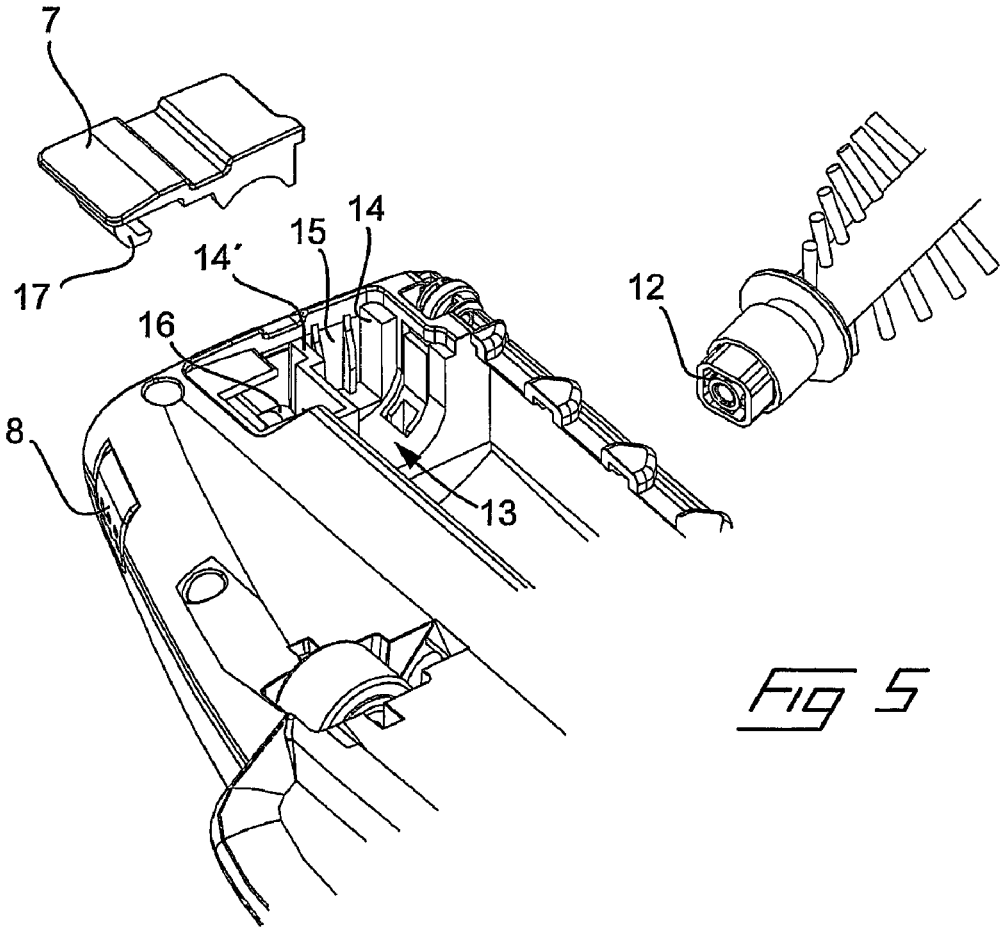
FIG. 5 is a perspective view illustrating the free rotating end of the vacuum cleaner nozzle and the brush.

Reference is now also made to FIGS. 4 and 5 for a more detailed explanation of the mechanism for driving and optional attachment or releasing of the brush from the vacuum cleaner nozzle. In a first, driving end, the vacuum cleaner nozzle comprises a driven wheel 9, which is provided with axially extending recesses 10, as is shown in FIG. 4. In the same end, the brush is provided with axially extending projections 11, which can go into engagement with the recesses 10 in the driven wheel 9 by moving the brush substantially in the axially direction towards the driven wheel 9. In the exemplary embodiment, the driving of the driven wheel is accomplished by means of a not shown electric motor inside the vacuum cleaner nozzle, which electric motor is coupled to the driven wheel.

In a second, free rotating end, as is shown in FIG. 5, the brush comprises an axle spindle 12, which is rotatable journalled on the end of the brush and which is square shaped in cross section. The vacuum cleaner nozzle comprises a rectangular recess 13, having two opposed plain walls 14, 14' being in parallel to the extension of the brush, in which the axle spindle 12 can be positioned by moving the brush in the laterally direction. The dimensions of the axle spindle 12 and the rectangular recess 13 are adapted such that the axle spindle 12 is held unrotatable in relation to the vacuum cleaner nozzle when positioned in the rectangular recess 13. Accordingly, the brush is held free rotating in relation to the vacuum cleaner nozzle by the axle spindle 12 in this end. Moreover, the length of the brush and the distance between the driven wheel 9 and an end wall 15 of the rectangular recess 13 are adapted such that the brush can not move in the axial direction in such a degree that it would disengage the brush from the driven wheel 9 in the driving end or from the rectangular recess 13 in the free rotating end. When the axle spindle 12 is positioned in the rectangular recess 13, the blocking element 7 can be placed over the rectangular recess 13, wherein a spring actuated ratchet element 16, connected to the release button 8, goes into engagement with a hook element 17 on the inner side of the blocking element 7. In this way the axle spindle 12 is prevented from disengagement with the rectangular recess 13 and the brush is held in a functional position in the vacuum cleaner nozzle.

Figure 6:
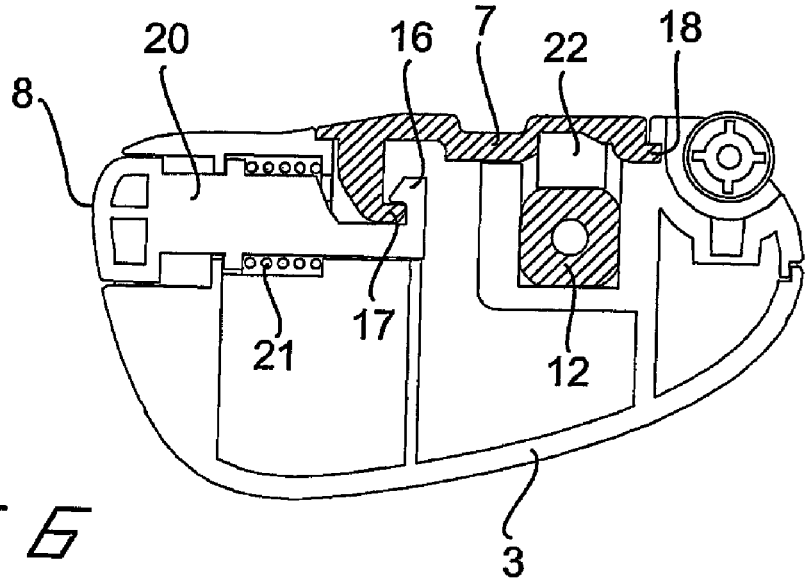
FIG. 6 is a cross sectional view along the line A-A in FIG. 2, showing the mechanism for releasing and locking the second end of the brush in a locked state.
Figure 7:
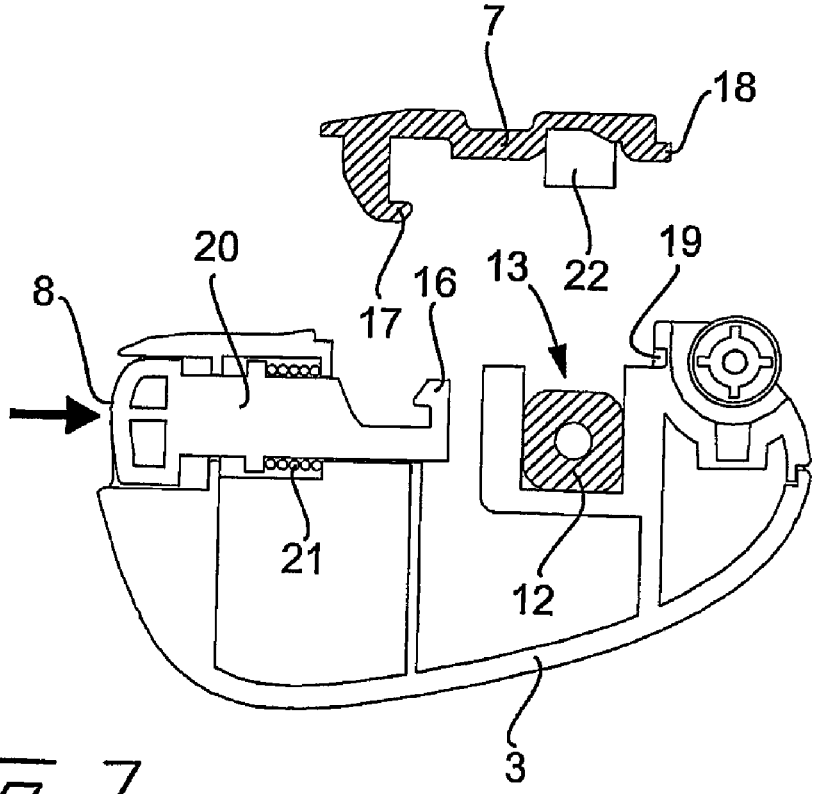
FIG. 7 is a view according to FIG. 6, showing a released state of the brush.

Reference is now made to FIGS. 6 and 7, which are cross sectional views along the line A-A in FIG. 2, for a more detailed description of the mechanism for releasing and locking the second end of the brush in the vacuum cleaner nozzle 3. As apparent from FIG. 6, which shows the brush in a locked state, one end of the blocking element 7 is held in the vacuum cleaner nozzle by means of a projecting portion 18 of the blocking element 7 being inserted into a corresponding slot 19 in the vacuum cleaner nozzle. The other end of the blocking element 7 is held in the vacuum cleaner nozzle by means of the ratchet element 16 of an actuator 20, which on the outside forms the release button 8. The ratchet element 16 is in engagement with the hook element 17 of the blocking element 7. The actuator 20 is spring actuated in the outward direction to the locked state by means of a spring 21. In this state, a contact formation 22 of the blocking element 7, bears against the square axle spindle 12 such that the brush is forced into the recess 13.

In FIG. 7 is illustrated the situation when the release button 8 is pushed inwards. The actuator 20 and the ratchet element 16 are then displaced inwards such that the hook element 17 is released. The end of the blocking element at the hook element 17 may then be released from the vacuum cleaner nozzle after which also the projecting portion 18 can be disengaged from the slot 19 and the blocking element 7 removed from the vacuum cleaner nozzle. The second end of the brush can now be removed from the recess 13 by moving it in the lateral direction and subsequently also the first end of the brush may be disconnected from the driven wheel 9 by moving the brush in the axial direction.

The invention claimed is:

1. A vacuum cleaner nozzle for cleaning of surfaces such as floors, comprising a rotatable, elongated brush (5), which is provided with brush means and located close to an air inlet opening to the vacuum cleaner, wherein the brush is rotatably driven and adapted to rotate during cleaning to brush off debris and dust from the surface or to accomplish agitation of the surface, wherein a first end of the brush (5) is adapted to be mounted in the vacuum cleaner nozzle (3) by moving the brush in an axial direction, while a second end of the brush is adapted to be mounted in the vacuum cleaner nozzle by moving the brush in a lateral direction, wherein the second end of the brush (5) is maintained in a recess (13) by means of a releasable blocking element (7) positioned over the recess, characterized in that the blocking element (7) is releasable without any need for a tool, wherein the blocking element (7) is releasable by means of a quick release actuator (20), and the quick release actuator (20) comprises a ratchet element (16) which can go into engagement with a mating hook element (17) on the blocking element (7).

2. The vacuum cleaner nozzle according to claim 1, wherein the quick release actuator (20) is a spring (21) actuated towards a locking state.

3. The vacuum cleaner nozzle according to claim 1, wherein the blocking element (7) comprises a projecting portion (18) in one end, which can go into engagement with a slot (19) in the vacuum cleaner nozzle.

4. A vacuum cleaner nozzle comprising:

a nozzle housing having a lower surface adapted to face a surface to be cleaned during cleaning operations;

an air inlet opening located on the lower surface of the nozzle housing;

a brush selectively mountable in the air inlet opening and adapted to be rotated to contact the surface being cleaned, wherein the brush comprises a shaft elongated in an axial direction and comprises:

a first brush end adapted to be mounted at a first air inlet opening end by moving the first brush end generally along the axial direction, a second brush end adapted to be mounted at a second air inlet opening end by moving the second brush end in a lateral direction generally perpendicular to the axial direction, and wherein the second brush end is maintained in a recess at the second air inlet opening end by a releasable blocking element selectively positioned over the recess, the blocking element being adapted to be selectively releasable by an operator without the use of a tool;

a quick-release actuator adapted to selectively release the blocking element, the quick-release actuator comprising a button having a first position in which the quick-release actuator holds the blocking element in place over the recess, and a second position in which the quick-release actuator allows the blocking element to be moved away from the recess, and wherein the quick-release actuator comprises a latch that engages a hook on the blocking element when the button is in the first position.

5. The vacuum cleaner nozzle of claim 4, wherein the quick-release actuator comprises a spring that biases the button towards the first position.

6. The vacuum cleaner nozzle of claim 4, wherein the blocking element comprises a projecting portion that engages a slot in the nozzle housing when the blocking element is positioned over the recess.

7. The vacuum cleaner nozzle of claim 4, wherein the vacuum cleaner nozzle further comprises a driven wheel rotatably mounted at the first air inlet opening end, the driven wheel being adapted to be rotated during operation of the vacuum cleaner nozzle.

8. The vacuum cleaner nozzle of claim 7, wherein the first brush end engages the driven wheel when the brush is mounted in the air inlet opening.

9. The vacuum cleaner nozzle of claim 8, wherein the first brush end engages the driven wheel by engagement between one or more projections and one or more recesses.

10. The vacuum cleaner nozzle of claim 9, wherein the one or more projections extend generally in the axial direction from the first brush end, and the one or more recesses extend generally in the axial direction into the driven wheel.

11. The vacuum cleaner nozzle of claim 10, wherein the second brush end comprises an axle spindle rotatably mounted to the shaft, the axle spindle being positioned to engage the recess at the second air inlet opening end when the brush is mounted in the air inlet opening, wherein the axle spindle and the recess are formed with corresponding shapes that prevent the axle spindle from rotating relative to the nozzle housing when the brush is mounted in the air inlet opening.

12. The vacuum cleaner nozzle of claim 7, wherein the second brush end comprises an axle spindle rotatably mounted to the shaft, the axle spindle being positioned to engage the recess at the second air inlet opening end when the brush is mounted in the air inlet opening, wherein the axle spindle and the recess are formed with corresponding shapes that prevent the axle spindle from rotating relative to the nozzle housing when the brush is mounted in the air inlet opening.

13. The vacuum cleaner nozzle of claim 4, wherein the second brush end comprises an axle spindle rotatably mounted to the shaft, the axle spindle being positioned to engage the recess at the second air inlet opening end when the brush is mounted in the air inlet opening, wherein the axle spindle and the recess are formed with corresponding shapes that prevent the axle spindle from rotating relative to the nozzle housing when the brush is mounted in the air inlet opening.

14. The vacuum cleaner nozzle of claim 13, wherein the blocking element comprises a surface adapted to contact the axle spindle and hold the axle spindle in the recess when the blocking member is positioned over the recess.

* * * * *

UNITED STATES PATENT AND TRADEMARK OFFICE

CERTIFICATE OF CORRECTION

PATENT NO. : 8,402,601 B2
APPLICATION NO. : 12/524323
DATED : March 26, 2013
INVENTOR(S) : Johan Fahlström It is certified that error appears in the above-identified patent and that said Letters Patent is hereby corrected as shown below:

On the Title Page

Item (73) Assignee should read: AB Electrolux, Stockholm (SE)

Item (30) Foreign Application Priority Data should read:

Jan. 23, 2007 (SE) 0700159-7

Item (57) ABSTRACT should read:

A vacuum cleaner nozzle having a nozzle housing having a lower surface, an air inlet opening located on the lower surface of the nozzle housing, and a brush selectively mountable in the air inlet opening and adapted to be rotated to contact a surface being cleaned. The brush includes an axially elongated shaft, a first brush end adapted to be mounted at a first air inlet opening end by moving it generally along the axial direction, and a second brush end adapted to be mounted at a second air inlet opening end by moving it in a lateral direction generally perpendicular to the axial direction. The second brush end is maintained in a recess at the second air inlet opening end by a releasable blocking element selectively positioned over the recess. The blocking element is adapted to be selectively releasable by an operator without the use of a tool.

Page 2, Item (56) U.S. PATENT DOCUMENTS, insert:

-- 2007/0226946 11/2007 Miefalk et al. --

Signed and Sealed this
Twentieth Day of August, 2013

Teresa Stanek Rea
*Acting Director of the United States Patent and Trademark Office*